US012637918B2

(12) United States Patent
Drury et al.

(10) Patent No.: US 12,637,918 B2
(45) Date of Patent: May 26, 2026

(54) DUAL-BOOSTER POWER CHARGE

(71) Applicant: DBK Industries, LLC, Crowley, TX (US)

(72) Inventors: Derrek D. Drury, Fort Worth, TX (US); Robert C. Andres, Fort Worth, TX (US)

(73) Assignee: DBK INDUSTRIES, LLC, Crowley, TX (US)

( * ) Notice: Subject to any disclaimer, the term of this patent is extended or adjusted under 35 U.S.C. 154(b) by 22 days.

(21) Appl. No.: 18/414,354

(22) Filed: Jan. 16, 2024

(65) Prior Publication Data

US 2024/0247557 A1 Jul. 25, 2024

Related U.S. Application Data

(60) Provisional application No. 63/439,991, filed on Jan. 19, 2023.

(51) Int. Cl.
*E21B 23/04* (2006.01)

(52) U.S. Cl.
CPC ..... *E21B 23/0414* (2020.05)

(58) Field of Classification Search
CPC . E21B 23/0414; E21B 43/1185; E21B 43/116
See application file for complete search history.

(56) References Cited

U.S. PATENT DOCUMENTS 1,430,959 A 10/1922 Dutcher
2,258,868 A 10/1941 Sherman
2,358,713 A 9/1944 Hutt
2,389,782 A 11/1945 Jackson, Jr.
2,412,018 A 12/1946 Vinton et al.
2,618,343 A 11/1952 Conrad
2,637,402 A 5/1953 Baker et al.
2,640,547 A 6/1953 Baker et al.
2,696,259 A 12/1954 Greene
2,707,999 A 5/1955 Ragan
2,848,194 A 8/1958 Forrest, V
3,244,232 A 4/1966 Myers
3,266,575 A 8/1966 Owen
3,401,632 A 9/1968 Griffith et al.
3,422,760 A 1/1969 Mohaupt
3,580,180 A 5/1971 Gawlick et al.
3,713,393 A 1/1973 O'Connor et al.
4,064,935 A 12/1977 Mohaupt
(Continued)

*Primary Examiner* — Shane Bomar
(74) *Attorney, Agent, or Firm* — Johnston IP Law, PLLC

(57) ABSTRACT

In one instance, a dual-booster power charge is disclosed for use in a downhole setting tool, wherein the dual-booster power charge has at least a first and a second booster charge disposed within a sleeve and embedded in a main power charge. Each booster charge has one end face that is exposed at the end of the dual-booster power charge. Each booster charge may have a first dimension near the end face that is smaller than a second dimension near the end of the booster charge that is not exposed. In some instances, the booster charges have a charge retention portion and a primary body portion, and a cross sectional diameter of the charge retention portion is larger than a cross sectional dimension of the primary body portion. Other dual-booster power charges and booster charges are disclosed.

14 Claims, 5 Drawing Sheets

(56) References Cited

U.S. PATENT DOCUMENTS

| | | | | | |
|---|---|---|---|---|---|
| 4,441,427 | A | * | 4/1984 | Barrett | F42B 3/18 102/202.1 |
| 4,530,396 | A | | 7/1985 | Mohaupt | |
| 4,649,827 | A | | 3/1987 | Brasquies et al. | |
| 4,657,089 | A | * | 4/1987 | Stout | F42B 3/192 102/318 |
| 4,768,439 | A | | 9/1988 | Singer et al. | |
| 4,976,318 | A | | 12/1990 | Mohaupt | |
| 5,070,788 | A | * | 12/1991 | Carisella | E21B 43/1185 102/222 |
| 5,159,146 | A | * | 10/1992 | Carisella | E21B 43/1185 102/222 |
| 5,396,951 | A | | 3/1995 | Ross | |
| 5,575,331 | A | * | 11/1996 | Terrell | E21B 29/02 166/212 |
| 6,422,148 | B1 | | 7/2002 | Xu et al. | |
| 9,453,382 | B2 | | 9/2016 | Carr et al. | |
| 10,107,054 | B2 | | 10/2018 | Drury et al. | |
| 10,883,327 | B1 | | 1/2021 | Drury et al. | |
| 2006/0048664 | A1 | | 3/2006 | Tiernan et al. | |
| 2007/0277694 | A1 | | 12/2007 | Wanninger | |
| 2011/0174185 | A1 | | 7/2011 | Epstein et al. | |
| 2015/0330171 | A1 | | 11/2015 | Cannon et al. | |
| 2017/0138164 | A1 | | 5/2017 | Mace et al. | |
| 2018/0163497 | A1 | | 6/2018 | Younger | |
| 2018/0340390 | A1 | | 11/2018 | Oag et al. | |
| 2020/0362654 | A1 | * | 11/2020 | Eitschberger | E21B 23/042 |
| 2023/0193711 | A1 | * | 6/2023 | Eitschberger | E21B 41/00 |
| 2025/0188810 | A1 | * | 6/2025 | Rairigh | F42B 3/08 |

* cited by examiner

DUAL-BOOSTER POWER CHARGE

CROSS-REFERENCE TO RELATED APPLICATION

This application claims the benefit of U.S. Provisional Application Ser. No. 63/439,991, filed on Jan. 19, 2023, entitled "Dual-Booster Power Charge," which is incorporated herein by reference in its entirety for all purposes.

TECHNICAL FIELD

This application is directed, in general, to downhole setting tools, and more particularly, to dual-booster power charges and methods.

BACKGROUND

The following discussion of the background is intended to facilitate an understanding of the present disclosure only. It should be appreciated that the discussion is not an acknowledgement or admission that any of the material referred to was part of the common general knowledge at the priority date of the application.

Oil and gas wells are drilled into earth formations by first creating a borehole and then running and cementing casing in the borehole. Downhole well tools such as bridge plugs, packers, cement retainers, and frac plugs are often run into cased wells and set using setting tools powered by flammable power charges. Conventional well tools providing well casing sealing assemblies typically include a packer having one or more elastomeric sealing elements that are squeezed between a packer mandrel and the casing. They are held in place by one or more slip assemblies that are wedged between conical sleeves of the packers and the casing. The packers are configured for use as bridge plugs, tubing packers, cement retainers, and frac plugs.

Power charges, or power cartridges, are used in oil and gas well setting tools as a source combustion component for igniting and burning to generate gasses that power the activation of downhole tools, such as those previously mentioned. Power charges are constructed of propellant mixtures composed of carefully controlled combustible elements containing an oxidizer, which, when ignited will begin a slow burn lasting approximately thirty seconds more or less. The gas derived from a burning power charge propellant mixture causes a setting tool to stroke, setting a downhole tool in a well or performing some desired work. While much progress has been made, improvements in power charges remain desirable.

SUMMARY

According to an illustrative embodiment, a dual-booster power charge for energizing a downhole tool includes a sleeve having a first end and second end and an interior cavity; a main power charge disposed within the interior cavity of the sleeve; a first booster charge comprising a first booster charge body having a first end and a second end; and a second booster charge comprising a second booster charge body having a first end and a second end. A first lateral dimension of the first end of the first booster charge is less than a second lateral dimension of the second end of the first booster charge. The first booster charge has an outward end face at the first end. The first booster charge is disposed within the main power charge proximate the first end of the sleeve such that the outward end face of the first booster charge is exposed. A first lateral dimension of the first end of the second booster charge is larger than a second lateral dimension of the second end of the second booster charge. The second booster charge has an outward end face at the second end. The second booster charge is disposed within the main power charge proximate the second end of the sleeve such that the outward end face of the second booster charge is exposed.

According to an illustrative embodiment, a dual-booster power charge for energizing a downhole tool includes a sleeve having a first end and second end and an interior cavity; a main power charge disposed within the interior cavity of the sleeve; a first booster charge having a first booster charge body having a first end and a second end, a first outward end face formed on the first booster charge proximate the first end of the booster charge, and an inboard lateral enlargement portion formed on the first booster charge body; a second booster charge including a second booster charge body having a first end and a second end, a first outward end face formed on the second booster charge proximate the second end of the booster charge, and an inboard lateral enlargement portion formed on the second booster charge body. The first end of the first booster charge has a first lateral dimension. The inboard lateral enlargement portion of the first booster charge has a second lateral dimension. The first lateral dimension of the first booster charge is less than a second lateral dimension of the first booster charge. The first booster charge is disposed within the main power charge proximate the first end of the sleeve such that the first outward end face of the first booster charge is exposed. The second end of the second booster charge has a first lateral dimension. The inboard lateral enlargement portion of the second booster charge has a second lateral dimension. The first lateral dimension of the second booster charge is less than the second lateral dimension of the first booster charge. The second booster charge is disposed within the main power charge proximate the second end of the sleeve such that the second outward end face of the second booster charge is exposed.

According to an illustrative embodiment, a power charge includes a sleeve having a first end and a second end and an interior cavity; a main power charge disposed within the interior cavity of the sleeve; a first booster charge having a first outward end face; and a second booster charge having a second outward end face. The first booster charge is disposed within the main power charge in the interior cavity of the sleeve proximate the first end of the sleeve with the first outward end face exposed. The second booster charge is disposed within the main power charge in the interior cavity of the sleeve proximate the second end of the sleeve with the second outward end face exposed.

DESCRIPTION OF THE DRAWINGS

Illustrative embodiments of the present invention are described in detail below with reference to the attached drawing figures, which are incorporated by reference herein and wherein.

DETAILED DESCRIPTION

In the following detailed description of the preferred embodiments, reference is made to the accompanying drawings that form a part hereof, and in which is shown, by way of illustration, specific embodiments in which the invention may be practiced. These embodiments are described in sufficient detail to enable those skilled in the art to practice the invention, and it is understood that other embodiments may be utilized, and that logical structural, mechanical, electrical, and chemical changes may be made without departing from the spirit or scope of the invention. To avoid detail not necessary to enable those skilled in the art to practice the invention, the description may omit certain information known to those skilled in the art. The following detailed description is, therefore, not to be taken in a limiting sense, and the scope of the present invention is defined only by the claims. Unless otherwise indicated, as used throughout this document, "or" does not require mutual exclusivity.

A fracking example is provided for context, but other applications may apply. In the fracking process, after a horizontal well is drilled and cased, perforating guns conveyed on coiled tubing or stick pipe, are fired in the horizontal section of the well. Once the perforated guns are fired and pulled out, the first stage is fractured. After that, it is desirable to isolate an upstream portion—above the previously perforated portion—and this is done by placing a frac plug. The frac plug with a setting tool is conveyed into the well as part of a bottom hole assembly (BHA) to the desired depth. At depth, the firing head is activated by an electrical current from a wireline truck that activates an igniter to then cause the power charge in a setting tool to activate. That in turn motivates movement of a barrel piston to do a full and complete stroke, which causes the setting tool to disconnect from the frac plug. In this process, the frac plug is sealed in the casing. The second zone is then treated and so forth until all the zones are perforated as desired.

Figure 1A:
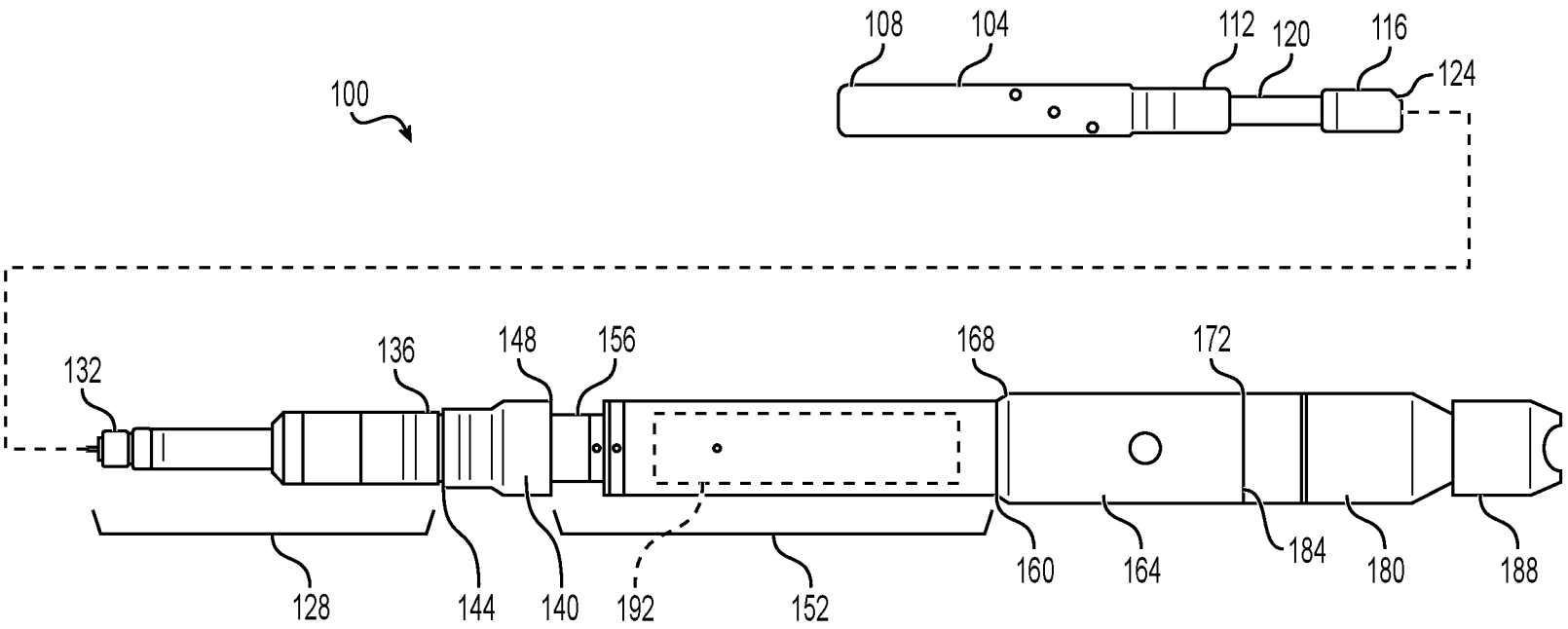
FIG. 1A is a schematic diagram of a bottom hole assembly that includes a gas-powered setting tool using a dual-booster power charge according to an illustrative embodiment.

Referring now primarily to FIG. 1A, a bottom hole assembly (BHA) 100 is shown. The upper most component of the bottom hole assembly 100 as shown is a perforating gun 104 having an upper end 108 (or first end) and a lower end 112 (or second end). The perforating gun 104 is followed by an adapter 116 having an upper end 120 (or first end) and a lower end (or second end) 124. The upper end 120 of the adapter 116 couples with the lower end 112 of the perforating gun 104. A quick change 128 may follow next. The quick change 128 has an upper end 132 (or first end) and a lower end 136 (or second end). Coupled to the quick change 128 is a firing head 140, which has an upper end 144 (or first end) and a lower end 148 (or second end).

Next, an illustrative embodiment of a setting tool 152, e.g., a gas-operated setting tool, follows. The setting tool 152 has an upper end 156 (or first end) and a lower end 160 (or second end). The setting tool 152 is coupled to a running gear 164 (or adapter), which has an upper end 168 (or first end) and a lower end 172 (or second end). The running gear 164 is coupled to an illustrative plug 180, e.g., a fracking plug or bridge plug or another downhole plug. The plug 180 has an upper end 184 (or first end) and a lower end 188 (or second end). In this embodiment, the firing head 140 is shown coupled to the setting tool 152 to provide ignition thereto when desired. It should be understood that other arrangements may be made such as including the igniter in the tool itself. This disclosure focuses on aspects related to a dual-booster power charge 192 within a combustion chamber in the setting tool 152.

Since the combustion chamber of the setting tool 152 is located inside the setting tool 152 and the dual-booster power charge 192 is located within the combustion chamber of the setting tool 152, the dual-booster power charge 192 is shown with broken lines in FIG. 1A. The igniter located within the firing head 140 is adjacent or near to the dual-booster power charge 192 to provide an ignition source. Once ignited, the dual-booster power charge 192 is burned. Burning of the dual-booster power charge 192 results in the release of combustion gases and typically creates gas pressure from 7,000 psi to 13,000 psi or higher within the setting tool. The gas pressure generated is used to operate or cycle a downhole tool, such as the setting tool 152 in the example of FIG. 1A.

Reference is now made generally to FIGS. 1A-10. In using a conventional power charge as part of a setting tool 152, a single booster charge may be added at one end of the power charge or sleeve 212. In this configuration, a single booster power charge has a booster pellet located at one face of the power charge. The remainder of the power charge is a main propellent. In this manner a single booster power charge has one face with an exposed booster pellet and another face with only main propellent exposed. This is suitable as long as the technicians in the field orient the power charge such that the booster pellet of the single booster charge is facing the firing head 140 or more specifically the igniter, i.e., the single booster charge is oriented so that the booster pellet of the single booster power charge is on an uphole side (left side on FIG. 1A as shown) of the single booster power charge.

Unfortunately, orienting the other way around can have bad consequences. In such a case, the single booster pellet of the single booster power charge is oriented so that it is on the downhole side of the single booster power charge (right side on FIG. 1A as shown). In this case, the single booster pellet is not adjacent or near to the igniter. Instead, it is separated by the main propellent of the single booster power charge. Therefore, the ignitor, located in the firing head 140 or elsewhere, is not able to ignite the booster pellet of the single booster power charge, as desired. Instead, the igniter faces or is adjacent to only the main propellent of the single booster power charge.

This is undesirable because it negates the purpose of the booster pellet within the power charge. While, the main propellant of the power charge, when ignited, produces the desired burn rate and gas production to activate the setting tool 152, it can be difficult to ignite the main propellant with the igniter alone. This may lead to a failure of ignition of the main propellent, a partial burn, delayed activation, insufficient gas generation, etc. To alleviate this concern, a booster pellet is placed at an end of the power charge, so that the booster pellet is exposed to the heat or flames of the igniter within the firing head 140. While, the chemical composition of the booster pellet may not produce the desired gas production to operate the setting tool 152 when ignited, the chemical composition of the booster pellet is configured so that the booster pellet ignites more readily than the main propellent. The chemical composition of the booster pellet is also configured to release sufficient energy to ignite the main propellant of the power charge. In this manner, failed or flawed activation of the setting tool 152 is avoided or reduced. The igniter, which may not ignite the main propellent, is used to ignite the booster pellet. The ignited booster pellet then causes ignition of the main propellent. When a single booster power charge is mis-oriented within the combustion chamber of the setting tool 152, so that the booster pellet is on the downhole side of the single booster power charge, the benefits of the booster pellet are removed.

Figure 1B:
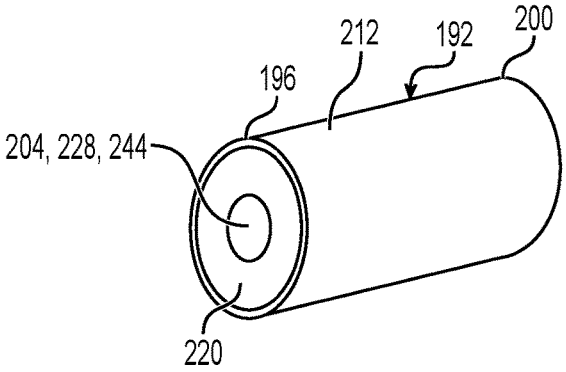
FIG. 1B is a schematic, perspective view of a dual-booster power charge according to an illustrative embodiment.
Figure 2:
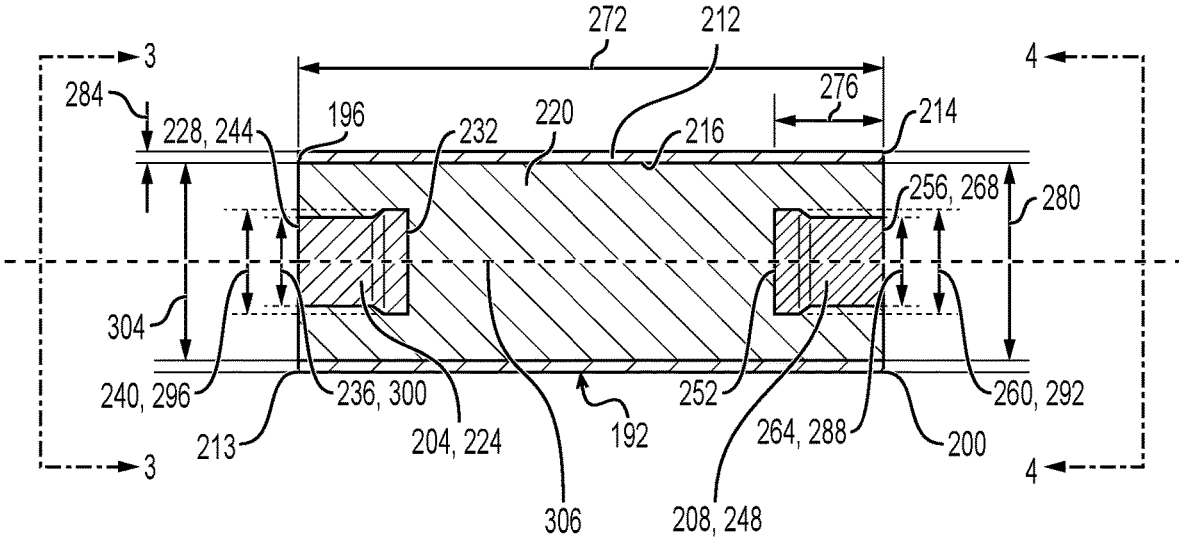
FIG. 2 is a schematic, cross-section view of the dual-booster power charge of FIG. 1B.

Now referring primarily to FIGS. 1B and 2, as an important aspect of the present disclosure, the dual-booster power charge 192, which has a first end 196 and a second end 200, is formed with a first booster charge 204 on the first end 196 and a second booster charge 208 on the second end 200. As used herein "booster charge" and "booster pellet" are synonymous. In this way, the dual-booster power charge 192 cannot be assembled into the setting tool 152 with an incorrect orientation, which ensures that at least one of the booster charges 204 or 208 will be adjacent or near to the igniter within the firing head 140 or elsewhere. Since the dual-booster power charge 192 has at least two boosters (booster charges 204 and 208) the charge 192 uses the term "dual" and is referred to as a "dual-booster power charge."

Referring now primarily to FIGS. 1B-4, an illustrative embodiment of the dual-booster power charge 192 is presented in more detail. The dual-booster power charge 192 is formed with a sleeve 212 forming an interior cavity 216 into which a main power charge 220 is disposed. The sleeve 212 has a first end 213 and a second end 214. The sleeve 212 may be any tubular or hollow component capable of containing the main power charge 220 and booster charges 204, 208. As shown clearly in FIG. 2, the booster charges 204, 208 are disposed within the interior cavity 216 with the main power charge 220 around the booster charges 204, 208 and holding the booster charges 204, 208 in position. The sleeve 212 may be formed from a fiberboard material, which will readily burn when the main power charge 220 is burned. The sleeve 212 may be made from cardboard, paper, plastic, fiberglass, metal, or other material. In one illustrative embodiment, the sleeve 212 is formed around a mandrel using three to four layers of a sheet of fiberboard material, wound to a total wall thickness of 0.030 inches to 0.060 inches. Those skilled in the art will appreciate that other dimensions and techniques may be used.

The main power charge 220 may comprise a mixture of combustible components, an oxidizer, and an epoxy binder. For example, in one illustrative embodiment, the main power charge comprises a mixture including sodium nitrate, PYRODEX, which is a smokeless black powder substitute, wheat flour, and a two-part epoxy composed of an epoxy resin and an epoxy hardener. The mixture is preferably mixed to a dough-like form, of a consistency similar to cookie dough, which is preferably tightly packed into the sleeve 212 to form a continuous mass of the main power charge 220 that fully fills the sleeve 212.

Each booster charge 204, 208 may be formed of any suitable ignition material. In one illustrative embodiment, the ignition material forming the booster charge 204, 208 includes sixty to seventy percent PYRODEX (which is a smokeless black powder substitute), ten percent potassium nitrate, three percent graphite, and carbon black, which are packed together with a binder to form a rigid unit or solid mass. The booster charges 204, 208 may have the same composition as each other or may have different compositions. Those skilled in the art will appreciate that other ignition material and compositions may be used.

Referring now primarily to FIG. 2, a cross section of the illustrative dual-booster power charge 192 is shown with the first booster charge 204 and the second booster charge 208 in an assembled position. Typically, the first booster charge 204 and the second booster charge 208 are analogous although oriented differently when inserted into the main power charge 220 within the sleeve 212.

The first booster charge 204 has a first booster charge body 224 having a first end 228 and a second end 232. The first booster charge 204 has a first lateral dimension 236 at the first end 228 that is less than a second lateral dimension 240 of the second end 232 (or of a first inboard lateral enlargement portion described below). In some embodiments, the first lateral dimension 236 is between 70% and 99% of the second lateral dimension 240. In some embodiments, the first lateral dimension 236 is 95% or less than the second lateral dimension 240. The first booster charge 204 has an outward end face 244 at the first end 228. The first booster charge 204 is disposed within the main power charge 220 proximate the first end 196 of the sleeve 212, such that the outward end face 244 is exposed.

The second booster charge 208 is analogous in this illustrative embodiment to the first booster charge 204. The second booster charge 208 has a second booster charge body 248 having a first end 252 and a second end 256. The second booster charge 208 has a first lateral dimension 260 of the first end 252 and a second lateral dimension 264 of the second end 256. The second lateral dimension 264 is less than the first lateral dimension 260 (or of a second inboard lateral enlargement portion described below). In some embodiments, the second lateral dimension 264 is between 70% and 99% of the first lateral dimension 260. In some embodiments, the second lateral dimension 264 is 95% or less than the first lateral dimension 260.

The second booster charge 208 has an outward end face 268 at the second end 214 of the sleeve 212. The second booster charge 208 is disposed within the main power charge 220 proximate the second end 214 of the sleeve 212 such that the outward end face 268 is exposed.

Those skilled in the art will appreciate the dimensions of the power charge 192 may vary for different applications. In one illustrative embodiment, the dimensions with reference to FIG. 2 are in the ranges shown in Table 1 below.

| Dimension | Range (inches) |
|---|---|
| 272 | 3.0-14.0 |
| 276 | 0.5-1.5 |
| 280 | 1.0-3.0 |
| 284 | 0.04-0.1 |
| 288 | 0.3-1.0 |
| 292 | 0.3-1.1 |
| 296 | 0.3-1.1 |
| 300 | 0.3-1.0 |
| 304 | 1.0-2.5 |

In one illustrative embodiment, the dimensions were as follows: dimension 272=4.3 inches; dimension 276=0.7 inches; dimension 280=1.612 inches; dimension 284=0.060 inches; dimension 288=0.625 inches; dimension 300=0.0625 inches; and dimension 304=1.492 inches. Again, those skilled in the art will appreciate that the dimensions may vary with different applications.

The booster charges 204, 208 may be embedded in the main power charge 220 at each end 213, 214, respectively, of the sleeve 212, prior to curing of the epoxy binder in the main power charge 220. Each booster charge 204, 208 may be centered in the sleeve 212, and exposed to the exterior of the power charge 192. The sleeve 212 and the booster charges 204, 208 may be concentrically disposed about a central longitudinal axis 306.

Figure 3:
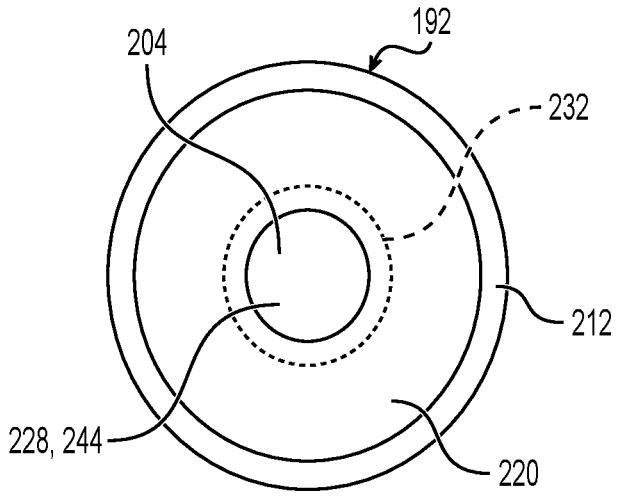
FIG. 3 is a schematic, end elevation view of the dual-booster power charge of FIG. 1B.
Figure 4:
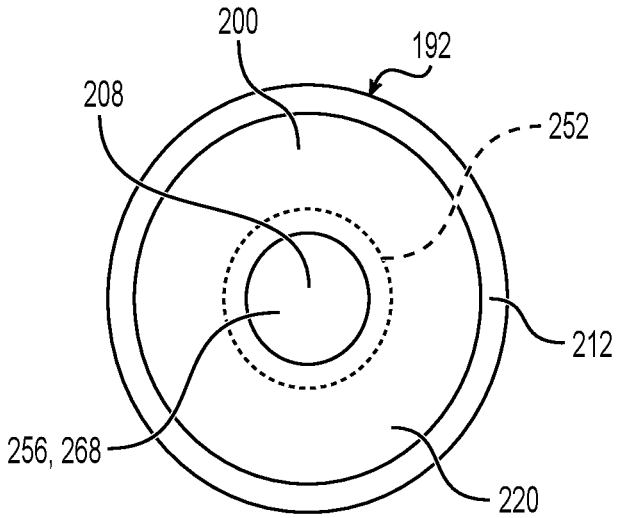
FIG. 4 is a schematic, end elevation view of the dual-booster power charge of FIG. 1B (opposite end from that shown in FIG. 3)

Referring now primarily to FIGS. 3 and 4, the first end 196 of an illustrative embodiment of a dual-booster power charge 192 is shown in FIG. 3, and the second end 200 of the illustrative embodiment of a dual-booster power charge 192 is shown in FIG. 4. Since the first booster charge 204 is positioned within the sleeve 212 with the outward end face 244 of the first booster charge 204 exposed at the first end 196 of the dual-booster power charge 192, the outward end face 244 of the first booster charge 204 is visible in FIG. 3. In FIG. 3, the second end 232 of the booster charge 204 is embedded within the main power charge 220 and is not exposed on the first end 196 of the dual-booster power charge 192. The second end 232 of the booster charge 204 is indicated by dashed lines in FIG. 3.

The second booster charge 208 is configured in an analogous manner to the first booster charge 204 except the second booster charge 208 is located at the second end 200 of the dual-booster power charge 192, as shown in FIG. 4. Since the second booster charge 208 is positioned within the sleeve 212 with the outward end face 268 of the second booster charge 208 exposed at the second end 200 of the dual-booster power charge 192, the outward end face 268 of the second booster charge 208 is visible in FIG. 4. In FIG. 4, the first end 252 of the booster charge 208 is embedded within the main power charge 220 and is not exposed on the second end 200 of the dual-booster power charge 192. The first end 252 of the booster charge 208 is indicated by broken lines in FIG. 4.

Figure 5:
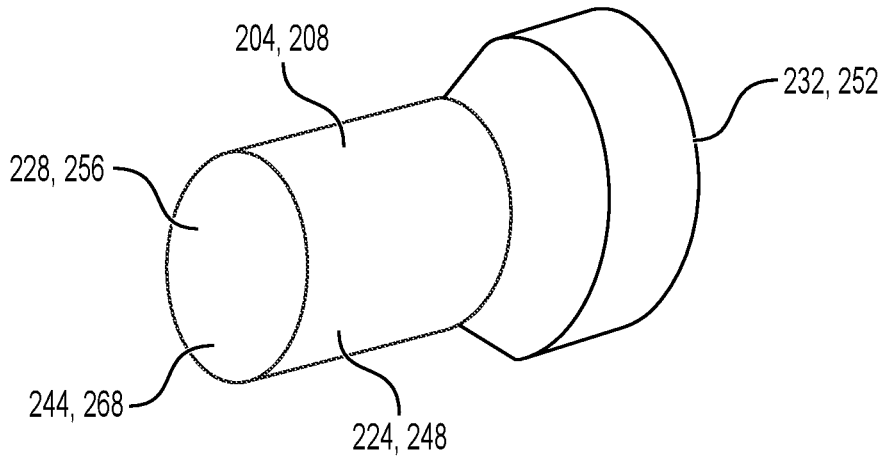
FIG. 5 is a schematic, perspective view of a booster charge according to an illustrative embodiment.
Figure 6:
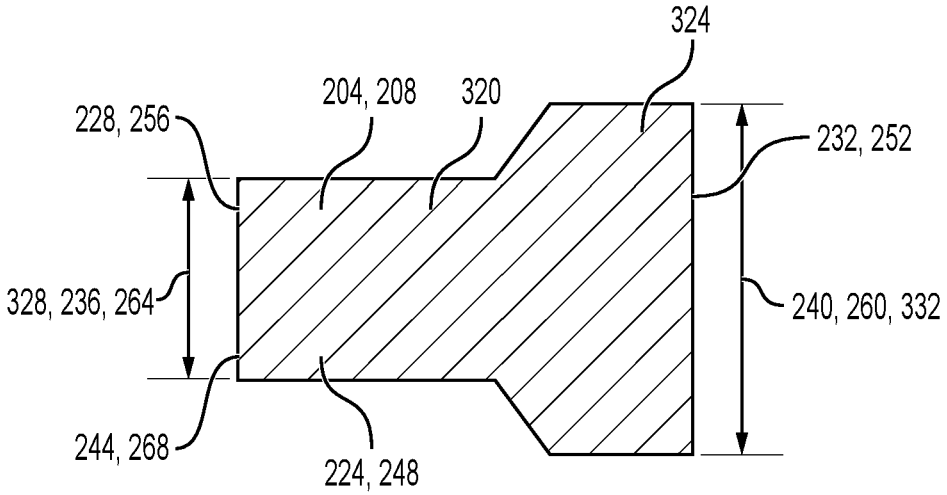
FIG. 6 is a schematic, cross-sectional view of the booster charge of FIG. 5.

Referring now primarily to FIGS. 5 and 6, an illustrative embodiment of a booster charge 204, 208 is presented. In this illustrative embodiment, the booster charge 204, 208 is annular in shape. In these views, one may appreciate that the lateral dimensions (the first lateral dimension 236 of the first booster charge 204 and the second lateral dimension 264 of the second booster charge 208) proximate first end 213 (for the first booster charge 204) and second end 214 (for the second booster charge 208) of the sleeve 212 when assembled are less than the lateral dimensions (the second lateral dimension 240 of the first booster charge 204 and the first lateral dimension 260 of the second booster charge 208) of the more inboard ends of the booster charges 204, 208, respectively.

In some embodiments the booster charges 204, 208 are annular in shape and have a primary body portion 320 and a charge retention portion 324. The primary body portion 320 has a cross sectional diameter 328. The charge retention portion 324 has a cross sectional diameter 332. The cross-sectional diameter 332 of the charge retention portion 324 is larger than the cross sectional diameter 328 of the primary body portion 320. In some embodiments, the charge retention portion 324 is fully embedded within the main power charge 220, when installed within the dual-booster power charge 192 so that the booster charge 204, 208 is retained within the sleeve 212 by the main power charge 220. The charge retention portion 324 is located farther from the exposed end (first end 228 of booster charge 204 or second end 256 of booster charge 204) than the end of the booster charge 204, 208 that is embedded within the main power charge 220 (second end 232 of booster charge 204 or first end 252 of booster charge 252). In some embodiments, the cross-sectional diameter 328 of the primary body portion 320 of the booster charge 204, 208 is 97% or less than the cross-sectional diameter 332 of the charge retention portion 324. In some embodiments, the cross-sectional diameter 328 of the primary body portion 320 of the booster charge 204, 208 is in the range of 97%-80% of the cross-sectional diameter 332 of the charge retention portion 324.

This arrangement assists in keeping the booster charges 204, 208 in place. When the booster charges 204. 208 are assembled within the interior cavity 216 of the sleeve 212, the main power charge 220 is placed into the interior cavity 216 and formed to fill the interior cavity 216 so that the main power charge 220 surrounds and conforms to the shapes of the booster charge 204, 208. By configuring the booster charges 204, 208 with the dimensions or shapes as described herein, the booster charges 204, 208 are effectively embedded within and captured by the main power charge 220 because the larger lateral dimensions of each of the booster charges 204, 208 are fully embedded within the main power charge 220 with the smaller lateral dimensions of each of the booster charges 204, 208 being exposed at the ends 213, 214 of the sleeve 212. In this manner, the booster charges 204, 208 cannot slide out or be knocked out of the sleeve 212 or separate from the main power charge 220.

Figure 7:
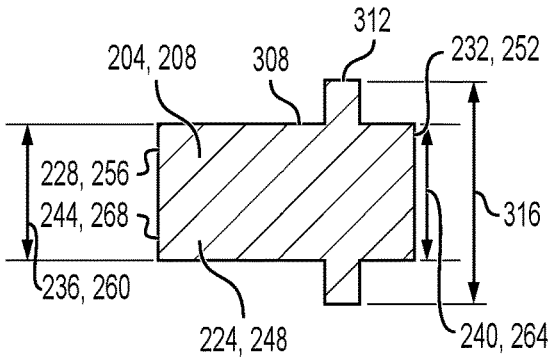
FIG. 7 is a schematic, cross-sectional view of a booster charge according to an illustrative embodiment.
Figure 8:
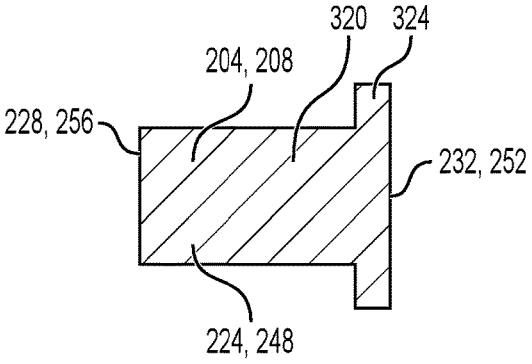
FIG. 8 is a schematic, cross-sectional view of a booster charge according to an illustrative embodiment.
Figure 9:
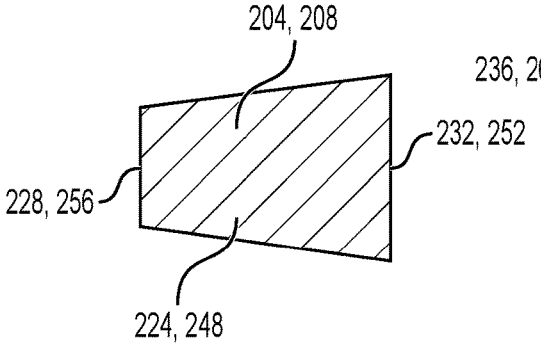
FIG. 9 is a schematic, cross-sectional view of a booster charge according to an illustrative embodiment.

FIGS. 7-9 show additional illustrative examples of the booster charges 204, 208 that have different shapes, as compared to the previously presented illustrative examples of the booster charge 204, 208. One should understand that many shapes may be used for the booster charges 204, 208.

FIG. 7 presents an illustrative embodiment of a booster charge 204, 208 having an intermediate portion 308 between the first end 228 and the second end 232 of the booster charge 204 or the second end 256 and the first end 252 of the booster charge 208, respectively. The intermediate portion 308 of the booster body 224, 248 has an inboard lateral enlargement portion 312. The inboard lateral enlargement portion 312 may be a ring shape or enlargement protruding from the body 224, 248 of the booster charge 204, 208 shaped to be wider than the first ends 228, 256 and second ends 232, 252 of the booster charges 204, 208. The inboard enlargement portion 312 holds the booster charge 204, 208 in place in the main power charge 220 since the inboard enlargement portion 312 is embedded within the main power charge 220 when installed within the dual-booster power charge 192. The inboard enlargement portion 312 has a lateral dimension 316 that is larger than the first dimension 236, 260 or the second dimension 240, 264 of the booster charge 204, 208, respectively. In the illustrative embodiment of the booster charges 204, 208 the first dimension 236, 260 and the second dimension 240, 264 are the same. However, in other embodiments the first dimension 236, 260 and the second dimension 240, 264 may be different. In other embodiments (e.g., FIGS. 6 and 8-10) the booster charge 204, 208 may also include an inboard lateral enlargement portion 312.

In the illustrative embodiment of FIG. 7, the inboard enlargement portion 312 is the charge retention portion 324 of booster charge 204, 208 and the remainder of the body 224, 248 of the booster charge 204, 208 is the primary body portion 320.

FIG. 8 presents an alternative illustrative embodiment of a power charge 204, 208. This illustrative embodiment of a power charge 204, 208 is analogous to the illustrative embodiment of a power charge 204, 208 presented in FIGS. 3 and 4, except the transition in diameter on the body 224, 248 of the power charge 204, 208 has a right-angle transition to form a smaller diameter first end 228 than the second end 232 of the booster charge 204 or a smaller diameter second end 256 than the first end 252 of the booster charge 208.

In the illustrative embodiment of FIG. 8, the charge retention portion 324 of booster charge 204, 208 is the larger diameter portion located at the second end 232 of the booster charge 204 or the first end 252 of the booster charge 208 and the remainder of the body 224, 248 of the booster charge 204, 208 is the primary body portion 320.

FIG. 9 presents an alternative illustrative embodiment of a dual-booster power charge 204, 208. This illustrative embodiment of a dual-booster power charge 204, 208 is analogous to the illustrative embodiment of a dual-booster power charge 204, 208 presented in FIGS. 3 and 4, except the transition in diameter on the body 224, 248 of the dual-booster power charge 204, 208 is a continuous taper transition from the first end 228 to the second end 232 of the booster charge 204 or from the second end 256 to the first end 252 of the booster charge 208 to form a smaller diameter first end 228 than the second end 232 of the booster charge 204 or a smaller diameter second end 256 than the first end 252 of the booster charge 208.

Figure 10:
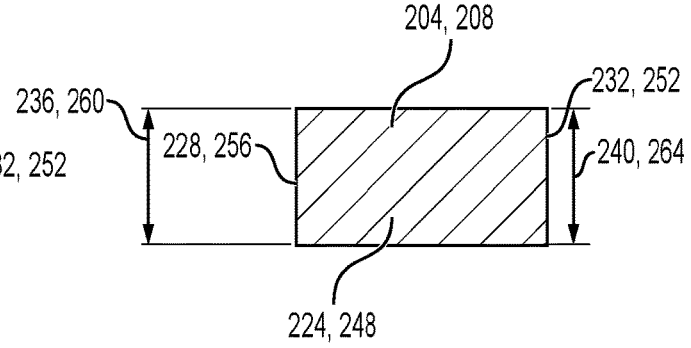
FIG. 10 is a schematic, cross-sectional view of a booster charge according to an illustrative embodiment.

FIG. 10 presents an alternative illustrative embodiment of a power charge 204, 208. This illustrative embodiment of a power charge 204, 208 is analogous to the illustrative embodiment of a charge 204, 208 presented in FIGS. 3 and 4, except the first dimension 236 and the second dimension 240 of the booster charge 204 and the second dimension 260 and the first dimension 264 of the booster charge 208 are equal.

It may be an advantage that the dual-booster power charge 192 may disposed with a combustion chamber of a gas-operated setting tool 152 with either the first end 196 or the second end 200 facing the firing head 140 without any disfunction. This may save operator errors that otherwise would cost time and money to resolve.

In addition to the examples given, many other examples may be provided. Additional examples follow.

Example 1. A dual-booster power charge for energizing a downhole tool comprising:

a sleeve having a first end and second end and an interior cavity;

a main power charge disposed within the interior cavity of the sleeve;

a first booster charge comprising:

a first booster charge body having a first end and a second end, wherein a first lateral dimension of the first end is less than a second lateral dimension of the second end, wherein the first booster charge has an outward end face at the first end, and wherein the first booster charge is disposed within the main power charge proximate the first end of the sleeve such that a first outward end face is exposed; and a second booster charge comprising:

a second booster charge body having a third end and a fourth end, wherein the second booster charge has a third lateral dimension proximate the third end and a fourth lateral dimension proximate the fourth end, wherein the fourth lateral dimension is less than a third lateral dimension, and wherein the second booster charge is disposed within the main power charge proximate the second end of the sleeve such that the second outward end is exposed.

Example 2. The dual-booster power charge of Example 1, wherein the first lateral dimension is 95% or less of the second lateral dimension.

Example 3. The dual-booster power charge of Example 1, wherein the first booster charge is annular shaped.

Example 3. The dual-booster power charge of Example 1, wherein the first booster body is annular in shape and the second booster body is annular shaped.

Example 4. A dual-booster power charge for energizing a downhole tool comprising:

a sleeve having a first end and second end and an interior cavity;

a main power charge disposed within the interior cavity of the sleeve;

a first booster charge comprising:

a first booster charge body having a first end and a second end, a first outward end face formed on the first booster charge proximate the first end of the booster charge;

a first inboard lateral enlargement portion formed on the first booster charge body, wherein the first end of the first booster charge has a first lateral dimension, wherein the first lateral dimension is less than a second lateral dimension of the first inboard lateral enlargement portion, and wherein the first booster charge is disposed within the main power charge proximate the first end of the sleeve such that the first outward end face is exposed; and a second booster charge comprising:

a second booster charge body having a first end and a second end, a second outward end face formed on the second booster charge proximate the second end of the booster charge;

a second inboard lateral enlargement portion formed on the second booster charge body, wherein the second end of the second booster charge has a second lateral dimension, wherein the second lateral dimension is less than a fourth lateral dimension of the second inboard lateral enlargement portion, and wherein the second booster charge is disposed within the main power charge proximate the second end of the sleeve such that the second outward end face is exposed.

Example 5. The dual-booster power charge of Example 4, wherein the first lateral dimension is 97% or less of the second lateral dimension.

Example 6. A power charge comprising:

a sleeve having a first end and second end and an interior cavity;

a main power charge disposed within the interior cavity of the sleeve;

a first booster charge having a first outward end face and wherein the first booster charge is disposed within the main power charge in the interior cavity of the sleeve proximate the first end of the sleeve and with the first outward end face exposed; and a second booster charge having a second outward end face and wherein the second booster charge is disposed within the main power charge in the interior cavity of the sleeve proximate the second end of the sleeve and with the second outward end face exposed.

In another embodiment, the power charge 204, 208 is formed with a body or enlarged portion that is other than annular, e.g., square, triangular, etc.

Although the present invention and its advantages have been disclosed in the context of certain illustrative, non-limiting embodiments, it should be understood that various changes, substitutions, permutations, and alterations can be made without departing from the scope of the invention as defined by the claims. It will be appreciated that any feature that is described in a connection to any one embodiment may also be applicable to any other embodiment.

What is claimed:

1. A dual-booster power charge for energizing a downhole tool comprising:

a sleeve having a first end and second end and an interior cavity;

a main power charge disposed within the interior cavity of the sleeve;

a first booster charge comprising:

a first booster charge body having a first end and a second end, wherein a first lateral dimension of the first end of the first booster charge is less than a second lateral dimension of the second end of the first booster charge, wherein the first booster charge has an outward end face at the first end, wherein the first booster charge is disposed within the main power charge proximate the first end of the sleeve such that the outward end face of the first booster charge is exposed; and a second booster charge comprising:

a second booster charge body having a first end and a second end, wherein a first lateral dimension of the first end of the second booster charge is larger than a second lateral dimension of the second end of the first booster charge, wherein the second booster charge has an outward end face at the second end, and wherein the second booster charge is disposed within the main power charge proximate the second end of the sleeve such that the outward end face of the second booster charge is exposed.

2. The dual-booster power charge of claim 1, wherein the first lateral dimension of the first booster charge is 95% or less of the second lateral dimension of the first booster charge.

3. The dual-booster power charge of claim 2, wherein the second lateral dimension of the second booster charge is 95% or less of the first lateral dimension of the second booster charge.

4. The dual-booster power charge of claim 1, wherein the first lateral dimension of the first booster charge is 90% or less of the second lateral dimension of the first booster charge and the second lateral dimension of the second booster charge is 90% or less of the first lateral dimension of the second booster charge.

5. The dual-booster power charge of claim 1, wherein the first booster charge body is annular in shape.

6. The dual-booster power charge of claim 1, wherein the second booster charge body is annular in shape.

7. A power charge comprising:

a sleeve having a first end and a second end and an interior cavity;

a main power charge disposed within the interior cavity of the sleeve;

a first booster charge having a first outward end face and wherein the first booster charge is disposed within the main power charge in the interior cavity of the sleeve proximate the first end of the sleeve and with the first outward end face exposed;

wherein the first booster charge has a first end and a second end, the first end being proximate to the first outward end face of the first booster charge;

wherein a diameter of the first booster charge proximate to the first end of the first booster charge is smaller than a diameter of the first booster charge proximate to the second end of the first booster charge;

a second booster charge having a second outward end face and wherein the second booster charge is disposed within the main power charge in the interior cavity of the sleeve proximate the second end of the sleeve and with the second outward end face exposed;

wherein the second booster charge has a first end and a second end, the second end being proximate to the second outward end face of the second booster charge; and wherein a diameter of the second booster charge proximate to the second end of the second booster charge is smaller than a diameter of the second booster charge proximate to the first end of the second booster charge.

8. The power charge of claim 7, wherein the first booster charge has a body with a primary body portion and a charge retention portion; and wherein the charge retention portion of an annular body of the first booster charge has a larger cross-sectional dimension than a cross sectional dimension of the primary body portion.

9. The power charge of claim 8, wherein the charge retention portion of the first booster charge is located closer to the second end of the first booster charge than to the first end of the first booster charge.

10. The power charge of claim 7, wherein second booster charge has a body with a primary body portion and a charge retention portion;

wherein the charge retention portion of the body of the second booster charge has a larger cross-sectional dimension than a cross sectional dimension of the primary body portion.

11. The power charge of claim 10, wherein the charge retention portion of the second booster charge is located closer to the first end of the second booster charge than to the second end of the second booster charge.

12. The power charge of claim 7, wherein the first booster charge has an annular body with a primary body portion and a charge retention portion; wherein the charge retention portion of the annular body of the first booster charge has a larger cross-sectional diameter than a cross-sectional diameter of the primary body portion of the first booster charge; wherein the second booster charge has an annular body with a primary body portion and a charge retention portion; and wherein the charge retention portion of the annular body of the second booster charge has a larger cross-sectional diameter than a cross-sectional diameter of primary body portion of the second booster charge.

13. The power charge of claim 12, wherein the cross-sectional diameter of the primary body portion of the first booster charge is 97% or less than the cross-sectional diameter of the charge retention portion of the first booster charge; and wherein the cross-sectional diameter of the primary body portion of the second booster charge is 97% or less than the cross-sectional diameter of the charge retention portion of the second booster charge.

14. The power charge of claim 13, wherein, the charge retention portion of the first booster charge is located closer to the second end of the first booster charge than to the first end of the first booster charge, and wherein the charge retention portion of the second booster charge is located closer to the first end of the second booster charge than to the second end of the second booster charge.

* * * * *